United States Patent [19]

Yanagisawa

[11] 4,350,136

[45] Sep. 21, 1982

[54] EXHAUST GAS RECIRCULATION VALVE

[75] Inventor: Syozo Yanagisawa, Tokaimura, Japan

[73] Assignee: Hitachi, Ltd., Tokyo, Japan

[21] Appl. No.: 240,856

[22] Filed: Mar. 5, 1981

[30] Foreign Application Priority Data

Mar. 7, 1980 [JP] Japan ..... 55-29677

[51] Int. Cl.[3] ..... F02M 25/06

[52] U.S. Cl. ..... 123/568; 137/DIG. 8

[58] Field of Search ..... 123/568, 569; 137/DIG. 8

[56] References Cited

U.S. PATENT DOCUMENTS

| | | | |
|---|---|---|---|
| 3,762,384 | 10/1973 | Day et al. | 123/568 |
| 4,198,030 | 4/1980 | Jackson | 123/568 X |
| 4,202,524 | 5/1980 | Brakebill | 123/568 X |

FOREIGN PATENT DOCUMENTS

| | | | |
|---|---|---|---|
| 2543804 | 4/1977 | Fed. Rep. of Germany | 123/568 |
| 55-119946 | 9/1980 | Japan | 123/568 |
| 55-148949 | 11/1980 | Japan | 123/568 |

*Primary Examiner*—Wendell E. Burns

*Attorney, Agent, or Firm*—Antonelli, Terry & Wands

[57] ABSTRACT

An exhaust gas recirculation valve including a passage structure defining therein an exhaust gas recirculation passage having provided therein an orifice. A movable valve member cooperates with the orifice for metering the exhaust gas flow therethrough. A tubular wall member projects into the exhaust gas recirculation passage and defines an axial bore having one end thereof facing to the valve member. A valve stem has one end thereof connected to the valve member and the other end disposed outside of the passage structure and connected to an actuator. The valve stem extends through the axial bore in the tubular wall member and a guide opening in the passage structure. The tubular member projects in the exhaust gas recirculation passage such a distance that when the valve member is into a position in which the volume of the exhaust gas flowing through the valve is maximized, the valve member is disposed close to but spaced from the one end of the axial bore in the tubular wall member, and the one end of the axial bore in the tubular wall member has a diameter at most equal to the maximum diameter of the valve member.

11 Claims, 11 Drawing Figures

EXHAUST GAS RECIRCULATION VALVE

BACKGROUND OF THE INVENTION

1. Field of the Invention

This invention relates to an exhaust gas recirculation valve (hereinafter referred to as EGR valve) of an exhaust gas recirculation system (hereinafter referred to as EGR system).

2. Description of the Prior Art

An EGR system is intended for drawing exhaust gas in part into the combustion chamber of an engine by suction to cause the temperature of combustion of a fuel-air mixture in the combustion chamber to drop and at the same time to reduce the amount of NOx in the exhaust gas that might otherwise be emitted through the exhaust pipe. The EGR system is provided with an EGR valve for controlling the volume of exhaust gas to be introduced into the combustion chamber of the engine.

One type of EGR system with an EGR valve is disclosed in U.S. Pat. No. 3,762,384. Description of its construction and operation will be omitted.

The exhaust gas introduced into the combustion chamber contains moisture and fine carbon powders. One tendency inevitably shown by the carbon powders is that they find their way into a guide opening formed in a guide plate for guiding a valve stem having attached thereto a valve member for metering the exhaust gas. As a result, the carbon powders are deposited on the wall of the guide opening and the serious problem of the valve stem becoming fast on the guide plate due to the carbon deposition blocking the guide opening for the valve stem.

SUMMARY OF THE INVENTION

This invention has as its object the provision of an EGR valve of a novel construction capable of reducing the volume of carbon entering the guide opening for the valve stem to extend therethrough.

The outstanding characteristics of the invention are as follows. The valve member connected to the valve stem is shaped to diverge in a direction in which the exhaust gas flows. A tubular wall member defining therein an axial bore is disposed at the side of the guide opening that faces to the exhaust gas recirculation passage of the valve with the axial bore communicating with the guide opening. The valve stem extends through the axial bore in the tubular wall member and the guide opening. The tubular wall member has a length which is such that when the valve member is moved to a position in which a maximum volume of exhaust gas is allowed to flow through the EGR valve, the valve member connected to the end of the valve stem is disposed close to but spaced from the tubular wall member, and the axial bore of the tubular wall member has a diameter which is substantially equal to or smaller than the maximum diameter of the valve member.

DESCRIPTION OF THE PREFERRED EMBODIMENTS

Figure 1:
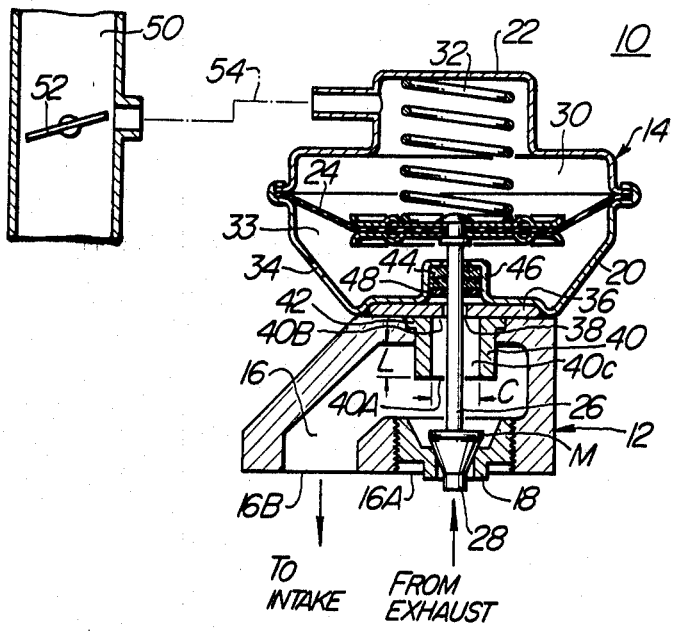
FIG. 1 is a schematic sectional view of an EGR system provided with the EGR valve constituting one embodiment of the invention.

Referring to FIG. 1, the numeral 10 designates an EGR valve comprising a passage structure 12 and a valve structure 14. The passage structure 12 which is formed by casting has an exhaust gas recirculation passage 16 and an orifice 18 threaded into the wall of the exhaust gas recirculation passage 16 midway thereof. Exhaust gas is recirculated from the exhaust system of the engine and passed through an exhaust gas inlet 16A into the orifice 18 from which it flows through the recirculation passage 16 and an exhaust gas outlet 16B to the intake system of the engine.

The valve structure 14 comprises a diaphragm 24 held between a first case 20 and a second case 22, a valve stem 26 secured to the diaphragm 24, a valve member 28 secured to the end of the valve stem 26 and having a conical shape diverging in the direction of flow of the exhaust gas, and a compression spring 32 mounted in a control pressure chamber 30 defined by the cooperation of the second case 22 and the diaphragm 24. The first case 20 and the diaphragm 24 cooperate with each other to define therebetween an atmospheric pressure chamber 33 into which atmospheric pressure is introduced through an aperture 34.

The valve structure 14 is secured by bolts at the first case 20 to the passage structure 12 so that the two structures 12 and 14 are held together. The valve stem 26 of the valve structure 14 extends through a guide opening 38 formed in a guide plate 36 held between the passage structure 12 and the first case 20 into the exhaust gas recirculation passage 16. It goes without saying that the valve member 28 secured to the end of the valve stem 26 cooperates with the orifice 18 to constitute a metering section.

A tubular wall member 40 formed as an entity separate from the passage structure 12 includes a flange 42 held between the guide plate 36 and an annular shoulder of the passage structure 12. The tubular wall member 40 is open at opposite ends 40A and 40B communicating with each other by a bore 40C through which the valve stem 26 extends. The open end 40A of the tubular wall member 40 remote from the guide opening 38 of the guide plate 36 projects into the exhaust gas recirculation passage 16 and is located in spaced juxtaposed relation to the valve member 28. The tubular wall member 40 which is annular in cross section is assembled with other parts in such a manner that the tubular wall member 40 is aligned with the guide opening 38, the valve stem 26, the valve member 28 and the orifice 18.

The portion of the tubular wall member 40 that projects into the exhaust gas recirculation passage 16 has a length L which is determined such that when the valve member 28 is moved to a position in which a maximum volume of exhaust gas is allowed to flow in recirculation through the EGR valve, a maximum diameter portion M of the valve member 28 is disposed close to the open end 40A of the tubular wall member 40. The open end 40A has a diameter C which is substantially equal to or smaller than the maximum diameter portion M of the valve member 28.

The first case 20 is formed at a portion thereof through which the valve stem 26 extends with a recess 46 for receiving therein a seal 44 of asbestos or carbon which is held in the recess 46 by a holder 48.

In the EGR valve of the aforesaid construction, the subatmospheric pressure or vacuum produced near a throttle valve 52 in a suction conduit 50 is introduced through a subatmospheric pressure passage 54 to the control pressure chamber 30 and urges the diaphragm 24 to move upwardly against the biasing force of the spring 32, so that the exhaust gas can be passed from the exhaust system to the intake system of the engine. This operation is described in detail in the U.S. patent referred to in the background of the invention.

The reason why the carbon powders in the exhaust gas are prevented from flowing into the guide opening 38 in the EGR valve shown and described hereinabove will now be described by referring to FIGS. 2 and 3.

Figure 2:
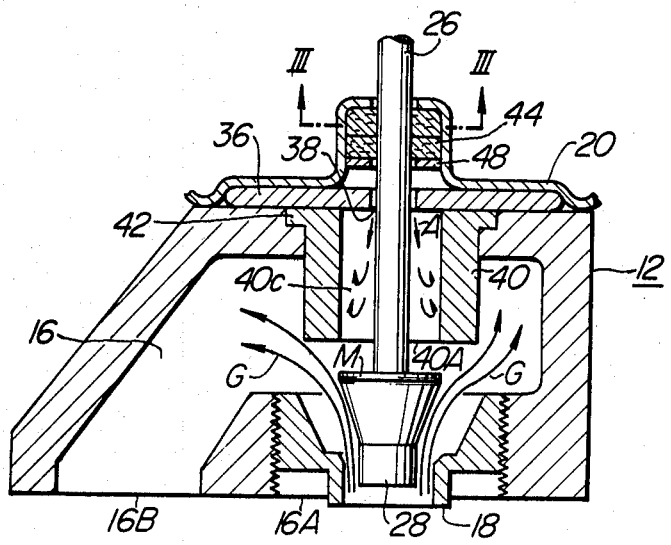
FIG. 2 is a sectional view, on an enlarged scale, of the essential portions of the EGR valve shown in FIG. 1.
Figure 3:
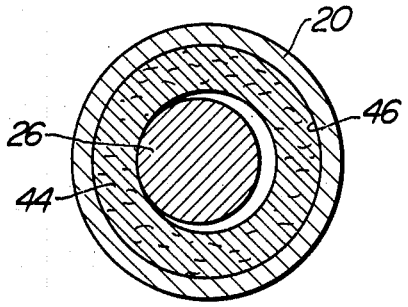
FIG. 3 is a sectional view taken along the line III—III in FIG. 2.

FIG. 2 shows the EGR valve in a position in which it allows the exhaust gas to flow in recirculation in a relatively large volume. The exhaust gas flows along the conical surfaces of the valve member 28 as indicated by arrows G. The exhaust gas flowing in this fashion has its direction of flow gradually changed until finally it flows in directions in which it flows away from the major diameter portion M of the valve member 28. Since the open end 40A of the tubular wall member 40 is disposed close to the major diameter portion M of the valve member 28, a proportion of the exhaust gas flowing into the bore 40C of the tubular wall member 40 through the open end 40A is small. Thus the volume of the carbon powders finding their way into the guide opening 38 is reduced. Owing to the facts that the exhaust gas has the direction of its flow changed by the valve member 28 and that the open end 40A of the tubular wall member 40 is disposed in a position in which the exhaust gas difficulty enters the open end 40A, the proportion of the exhaust gas flowing into the open end 40A of the tubular wall member 40 can be minimized to thereby reduce the volume of the carbon powders invading the guide opening 38, thereby preventing the valve stem 26 from getting fast on the guide plate 36 due to the blocking of the guide opening 38 by the carbon deposition.

In the embodiment shown in FIG. 2, besides the aforesaid features involving the valve member 28 and the tubular wall member 40, the air passing into the bore 40C of the tubular wall member 40 is also a factor concerned in avoiding the invasion of the guide opening 38 by the carbon powder. More specifically, the valve stem 26 and the seal 44 are disposed relative to each other in positions shown in FIG. 3 in which the relative positions are exaggerated to a certain extent to enable the invention to be better understood. The reason why such relative positions are occupied by the valve stem 26 and the seal 44 is that since the valve stem 26 is secured to the diaphragm 24 which is urged by the biasing force of the spring 32 to move downwardly, the valve stem 26 tends to become off-center and come into contact with the inner periphery of the seal 44 without extending through the center thereof. Thus a gap is formed between the valve stem 26 and the seal 44 and air passes through this gap in the direction of arrows A into the bore 40C of the tubular wall member 40. The volume of air flow is about 1–4 liters per minute. Meanwhile the exhaust gas recirculation passage 16 is in communication with the suction system, so that a pressure of about −300 to −400 mmHg prevails in the passage 16. Thus a pressure differential exists between the interior of the bore 40C of the tubular wall member 40 and the interior of the exhaust gas recirculation passage 16 and has detering effects on the flow of the exhaust gas into the bore 40C of the tubular wall member 40.

Various modifications of the tubular wall member 40 will be described by referring to FIGS. 4–8.

Figure 4:
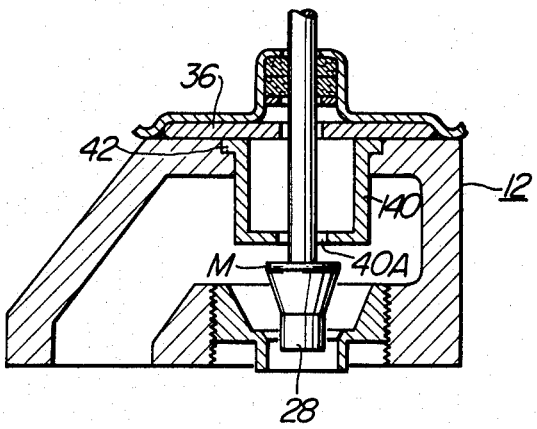
FIG. 4 is a sectional view, on an enlarged scale, of the essential portions of the EGR valve constituting another embodiment of the invention.

In the modification shown in FIG. 4, the open end 40A of the bore 40C of the tubular wall member 140 adjacent the valve member 28 has a diameter which is smaller than the maximum diameter portion M of the valve member 28. This modification can achieve the increased effect of reducing the volume of the exhaust gas flowing into the bore 40C of the tubular wall member 140.

Figure 5:
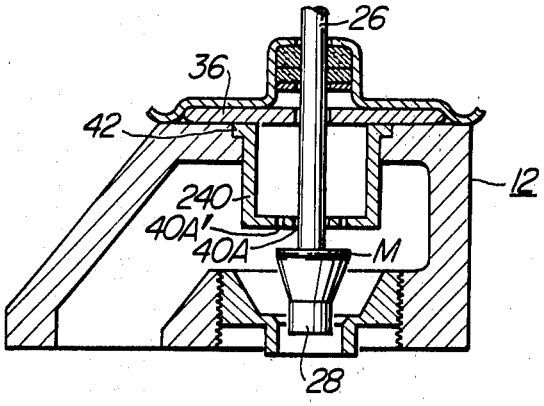
FIG. 5 is a sectional view, on an enlarged scale, of the essential portions of a modification of the EGR valve shown in FIG. 4.

FIG. 5 illustrates a modification of the embodiment shown in FIG. 4, in whch the tubular wall member 240 is formed, in addition to the open end 40A for the valve stem 26 to move therethrough, with openings 40A' in a position corresponding to the periphery of the maximum diameter portion M of the valve member 28. This modification in FIG. 5 achieves effect intermediate between the effect achieved by the embodiment shown in FIG. 2 and the effect achieved by the embodiment shown in FIG. 4.

Figure 6:
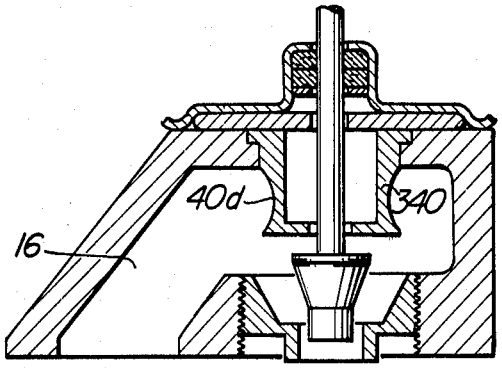
FIGS. 6, 7 and 8 are sectional view, on an enlarged scale, of the essential portions of other embodiments of the EGR valve in conformity with the invention.

FIG. 6 shows a modification having an annular concave groove **40*d* formed on the outer periphery of the portion of the tubular wall member 340 that projects into the exhaust gas recirculation passage 16. The provision of the annular concave groove 40*d* has the effect of compensating, as much as possible, for an increase in the resistance offered to the flow of exhaust gas by a reduction in the cross-sectional area of the passage 16 caused by the projection of the tubular wall member 340** thereinto.

Figure 7:
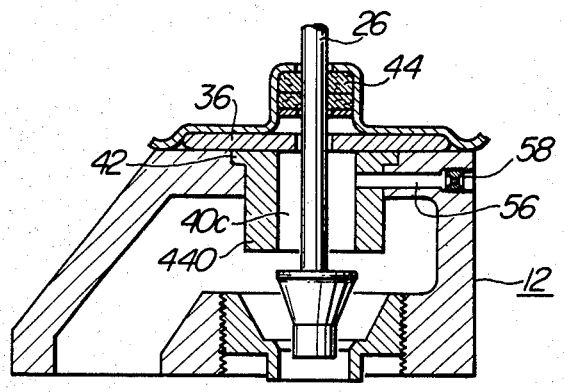

The modification shown in FIG. 7 is formed with an air passage 56 for introducing air therethrough into the bore **40*c* of the tubular wall member 440. An orifice 58 is provided in the air passage 56. The provision of the air passage 48 with the orifice 58 has the effect of supplying additional air when the air flowing into the bore 40*c* of the tubular wall member 440 from between the valve stem 26 and the seal 44 is small in volume and of introducing air into the bore 40*c* of the tubular wall member 440 when the valve stem 26 and the passage structure 12** are mounted in airtight relation by means of a bellows, not shown.

Figure 8:
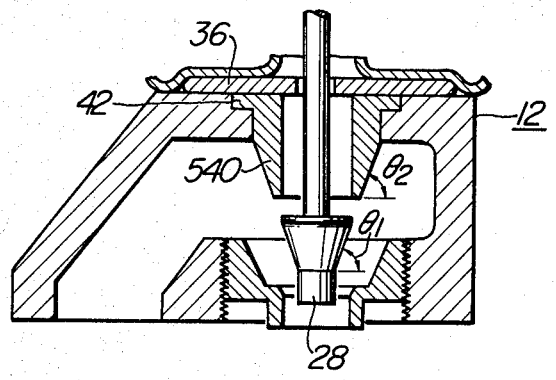

In the modification shown in FIG. 8, the tubular wall member 540 is conical at its outer periphery at an angle of inclination $\theta_2$ which is substantially of the same degree as the angle of inclination $\theta_1$ of the outer periphery of the valve member 28. In this modification, the flow of the exhaust gas having its direction changed by the valve member 28 is passed along the conical outer surface of the tubular wall member 540, to thereby further reduce the volume of the exhaust gas introduced into the bore **40*c* of the tubular wall member 540 through the open end 40A**.

Figure 9:
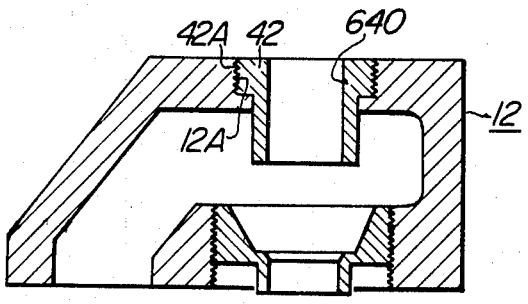
FIGS. 9 and 10 are sectional views, on an enlarged scale, of the tubular wall member and the passage structure as they are secured to each other.
Figure 10:
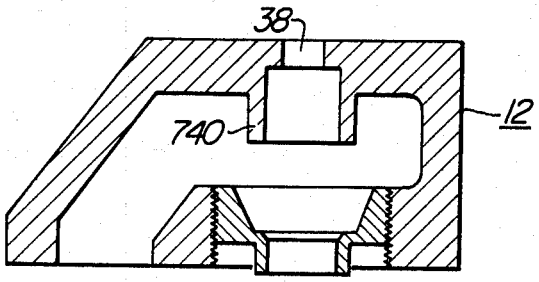

FIGS. 9 and 10 show means for mounting the tubular wall member 640, 740 at the passage structure 12. In the embodiments shown in FIGS. 2 and 4–8, the tubular wall member 40, 140, 240, 340, 440, 540 is secured to the passage structure 12 by letting the flange 42 of the former held between the passage structure 12 and the guide plate 36. In the modification shown in FIG. 9, however, the tubular wall member 640 is secured to the passage structure 12 to provide a unitary structure by threadably fitting an externally threaded portion 42A of the flange 42 of the tubular wall member 640 in an internally threaded portion 12A of the passage structure 12.

Figure 11:
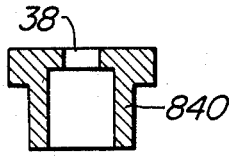
FIG. 11 is a sectional view, on an enlarged scale, of a modification of the tubular wall member.

The modification shown in FIG. 10 has the passage structure 12 formed integrally with the tubular wall member 740 by casting. In this modification, the guide opening 38 is formed in the passage structure in alignment with the tubular wall member 740. It goes without saying that although in the modification shown in FIG. 10 the guide opening 38 is fored in the passage structure 12 having integrally formed the tubular wall member 740, the guide opening 38 in other embodiments shown in FIGS. 2 and 4–9 may be formed in the tubular wall member 840 per se as shown in FIG. 11.

From the foregoing description, it will be appreciated that the invention enables the volume of the exhaust gas flowing through the guide opening formed in the passage structure for guiding the valve stem to be reduced, to thereby avoid deposition of carbon on the wall of the guide opening which might cause the valve stem to become fast in the guide opening.

What we claim is:

1. An exhaust gas recirculation valve comprising:

(a) a passage structure defining therein an exhaust gas recirculation passage having an exhaust gas inlet and an exhaust gas outlet, said passage structure including an orifice provided in said exhaust gas recirculation passage, and a guide opening communicating said exhaust gas recirculation passage and the outside of said passage structure with each other;

(b) a valve member having its outer periphery diverging in a direction in which exhaust gas flows, said valve member cooperating with said orifice and being movable relative to said orifice between a first position in which exhaust gas flow passing through said orifice is maximized and a second position in which the exhaust gas flow passing through said orifice is minimized;

(c) a valve stem having one end thereof connected to said valve member and extending through said guide opening, said valve stem having the other end thereof disposed outside of said passage structure, said valve stem having a diameter slightly smaller than the diameter of said guide opening;

(d) actuator means associated with the other end of said valve stem for actuating said valve stem to move said valve member between said first and second positions;

(e) a tubular wall member projecting into said exhaust gas recirculation passage, said tubular wall member defining therein an axial bore having one end thereof facing to and communicating with said guide opening and the other end facing to said valve member, said valve stem extending through said axial bore;

(f) said tubular wall member projecting into said exhaust gas recirculation passage a distance which is such that when said valve member moves to said first position, said valve member is located close to but spaced from said the other end of said axial bore in said tubular wall member; and (g) said the other end of said axial bore in said tubular wall member having a diameter at most equal to the maximum diameter of said valve member.

2. An exhaust gas recirculation valve defined in claim 1, wherein said actuator means comprises:

(a) a first case secured to said passage structure and having an aperture through the wall of said first case;

(b) a second case secured to said first case;

(c) a diaphragm held between said first case and said second case, said the other end of said valve stem being secured to said diaphragm, said diaphragm cooperating with said first case to define therebetween an atmospheric chamber communicating with the atmosphere through said aperture, said diaphragm cooperating with said second case to define therebetween a control vacuum chamber; and (d) a compression spring mounted in said control vacuum chamber for normally urging said valve member toward said second position.

3. An exhaust gas recirculation valve defined in claim 2, wherein said valve stem, said guide opening, said axial bore in said tubularwall member, said valve member and said orifice are substantially in alignment with each other.

4. An exhaust gas recirculation valve defined in claim 2, further comprising an annular seal disposed on the side of said guide opening adjacent to said diaphragm, said valve stem moving in sliding movement through said annular seal in such a manner that air is allowed to flow in a slight amount between said annular seal and said valve stem into said guide opening.

5. An exhaust gas recirculation valve defined in claim 1, wherein said passage structure includes a separate guide plate having therein said guide opening, said tubular wall member being held between said guide plate and said passage structure.

6. An exhaust gas recirculation valve defined in claim 1, wherein said tubular wall member is formed at its outer periphery with an externally threaded portion, and wherein said passage structure is formed with an internally threaded portion, said tubular wall member and said passage structure being assembled with each other into a unitary structure by the threaded engagement of said externally threaded portion of said tubular wall member with the internally threaded portion of said passage structure.

7. An exhaust gas recirculation valve defined in claim 1, wherein said tubular wall member is formed integrally with said passage structure.

8. An exhaust gas recirculation valve defined in claim 1, wherein said tubular wall member is formed separately from said passage structure, said guide opening being formed in said tubular wall member.

9. An exhaust gas recirculation valve defined in claim 1, wherein said tubular wall member is formed on its outer periphery with an annular concave groove.

10. An exhaust gas recirculation valve defined in claim 1, wherein said tubular wall member has its outer periphery diverging in a direction in which the exhaust gas flows.

11. An exhaust gas recirculation valve defined in claim 10, wherein the angle of inclination of the outer periphery of said tubular wall member is substantially equal to the angle of inclination of the diverging outer periphery of said valve member.

* * * * *